United States Patent [19]

Comeau

[11] Patent Number: 4,488,715

[45] Date of Patent: Dec. 18, 1984

[54] APPARATUS FOR SUPPORTING THE ARM OF A PATIENT ON AN OPERATING TABLE

[76] Inventor: Perry J. Comeau, Rte. 3, Box 15, Valley Dr., Searcy, Ark. 72143

[21] Appl. No.: 431,684

[22] Filed: Feb. 28, 1983

[51] Int. Cl.[3] ..... A61G 13/00

[52] U.S. Cl. ..... 269/328

[58] Field of Search ..... 269/328, 239, 275, 289 R; 128/133, 85, 87 R, 77; 5/431, 443; 248/118

[56] References Cited

U.S. PATENT DOCUMENTS

| | | | |
|---|---|---|---|
| 1,376,280 | 4/1921 | Jumes | 248/118 |
| 1,632,160 | 6/1927 | Barnes | 248/118 |
| 1,695,549 | 12/1928 | Hausler | 248/118 |
| 2,047,441 | 7/1936 | Starbuck | 248/118 |
| 2,950,890 | 8/1960 | Hough | 248/118 |
| 3,010,452 | 11/1961 | Smith | 128/133 |
| 3,027,895 | 4/1962 | Williams | 128/133 |
| 3,526,006 | 9/1970 | Beardmore | 128/77 |
| 4,232,681 | 11/1980 | Tulaszewski | 128/133 |
| 4,299,213 | 11/1981 | Violet | 128/133 |
| 4,323,080 | 4/1982 | Melhart | 128/133 |
| 4,390,015 | 6/1983 | Clements | 269/328 |

FOREIGN PATENT DOCUMENTS

| | | | |
|---|---|---|---|
| 376041 | 5/1923 | Fed. Rep. of Germany | 128/133 |

*Primary Examiner*—Robert C. Watson

*Attorney, Agent, or Firm*—Head, Johnson & Stevenson

[57] ABSTRACT

Apparatus for supporting the arm of a patient on an operating table formed of a member of relatively thin rigid material with an integral generally planar tongue portion configured to extend between the body of a patient, the member having an integral arm receiving portion of a length to receive at least a substantial portion of the arm of the patient, the arm receiving portion being upwardly curved, the outer edge being above the plane of the tongue portion of a height of about the thickness of the arm of the user, cushion material on the surface of the arm receiving portion to cushion the arm of the user and a retention member affixed to the arm receiving portion and extending over the arm of the patient to retain the patient's arm in position on the arm receiving portion.

7 Claims, 6 Drawing Figures

APPARATUS FOR SUPPORTING THE ARM OF A PATIENT ON AN OPERATING TABLE

SUMMARY OF THE INVENTION

The present invention is directed towards an apparatus for use in supporting the arm of a patient while on an operating table. In order to provide easy access of a surgeon to a patient positioned on an operating table, it is necessary that the width of the table be relatively narrow. For this reason, it is sometimes difficult to support the arm or arms of a patient during surgery and post-surgery activites.

If the arm of a patient during or after an operation while on an operating table is not carefully positioned, there are several risks involved. For instance, pressure on the ulnar or radial nerve of the arm for an extended length of time can lead to paralysis or palsy in the arm and even recurrent paresthesia in the arm and hand. In addition, the improper positioning of the arm of the patient can result in the occlusion of intravenous solution administration tubing and arterial lines that might be placed in the arm in order to monitor the patient. In addition, it is important that the arms of the patient be carefully protected while the patient is subject to anesthesia and is unable to protect his own limbs.

The present invention provides an apparatus which is expeditiously utilized in conjunction with an operating table. The apparatus is in the form of a member of relatively thin rigid material such as metal, plastic, fiberglass, or the like. It has an integral generally planar tongue portion which is configured to extend under the back of the patient, that is, between the patient and the support surface of an operating table. The member has an integral arm receiving portion extending from the tongue portion of a length to receive at least a substantial portion of the arm of a patient. The arm receiving portion is upwardly curved so that the outer longitudinal edge is at a height above the plane of the tongue portion equal to or about the thickness of the arm of the user.

Means is provided on the arm receiving portion to cushion the arm of a patient such as the use of egg crate foam plastic material.

A means is provided to retain the arm of a patient in engagement with the cushioned surface of the arm receiving portion such as the use of straps extending over the arm which may be attached to each other by Velcro fastening means. Another method employs the use of a rigid arm retention member of semi-circular cross-sectional configuration which is the same length of the arm receiving portion. The retention member is pivotally secured to the arm receiving portion along one edge of each of these members so that it can be pivoted to the open position to receive the arm of the patient and then pivoted to the closed position to retain the patient's arm in proper position. A self-locking hinge may be employed or other means to retain the retention member in the closed position.

DETAILED DESCRIPTION

Figure 3:
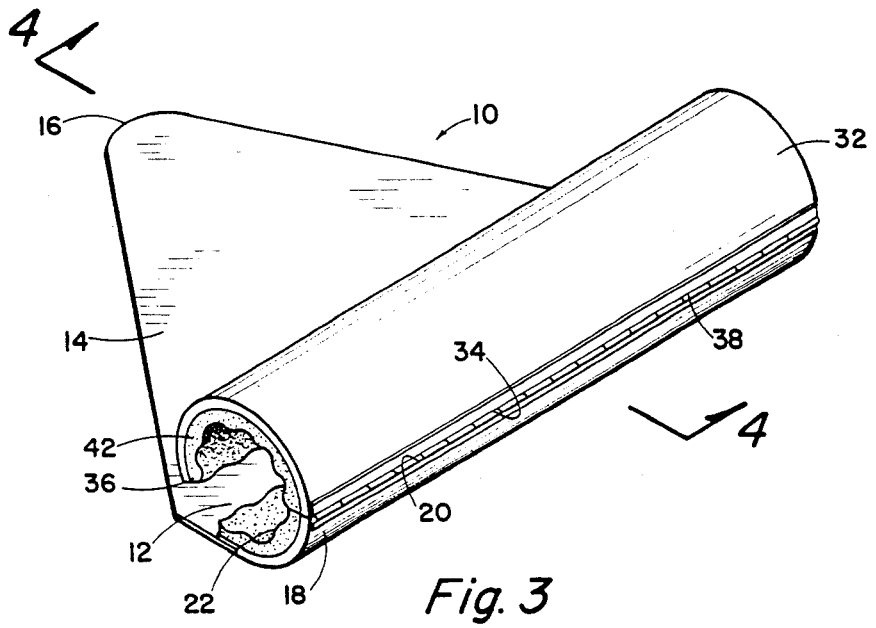
FIG. 3 is an isometric view of an alternate embodiment of the invention wherein the arm retention means is an elongated semi-circular device of rigid material which is pivoted to the arm support portion of the base member.
Figure 2:
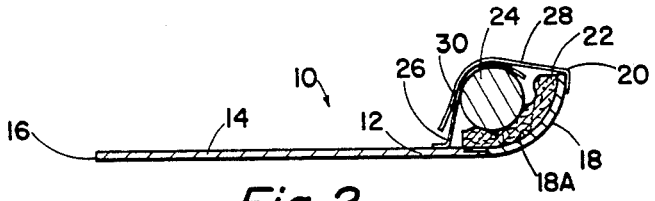
FIG. 2 is a cross-sectional view, taken along the line 2—2 of FIG. 1, in somewhat reduced dimensions, showing the arm of a user received and supported by the device.
Figure 1:
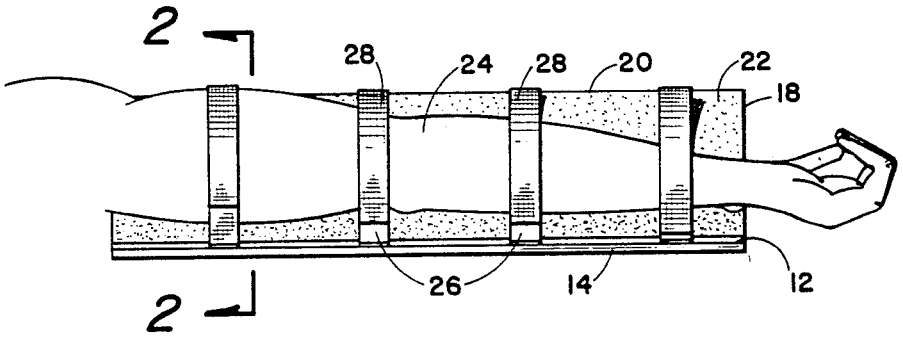
FIG. 1 is an elevational view of an apparatus to support the arm of a user on an operating table.

Referring to the drawings, and first to FIGS. 1 and 2, an embodiment of the invention is illustrated. The apparatus for supporting the arm of a patient on an operating table is generally indicated by the numeral 10 and includes a member of relatively thin rigid material 12 having an integral generally planar tongue portion 14. The tongue portion 14 is preferably tapered towards the inner end 16 as shown in FIG. 3. In use, the tongue portion 14 is positioned under the body of a patient, that is, between the patient and the support surface of an operating table. By provision of the pointed configuration for the tongue portion 14, the ease with which the device may be inserted under a patient is facilitated.

The member 12 terminates at its outer end with an arm receiving portion 18 which is upwardly curved. The arm receiving portion 18 is elongated and of a length to receive at least a substantial portion of the arm of a patient. The upwardly curved arm receiving portion terminates in a longitudinal edge 20 which is above the plane of the member 12 at a height substantially equal the thickness of the arm of a user.

Positioned on the inner surface 18A of the arm receiving portion is a cushion member 22 made of soft material such as foam plastic. In a preferred arrangement the cushion material 22 is of egg crate configuration so as to support the arm of the user with greatest comfort and least chance of interfering with vessels, nerves, I.V. tubes, etc.

FIGS. 1 and 2 show the arm 24 of a user as supported by the device.

While the arm receiving portion 18 may be made integral with the body portion 12 and tongue portion 14, such as forming these members of a single sheet of plastic, metal, fiberglass, etc., it can be seen that the arm receiving portion 18 may be separately formed and secured to the body member 12 along a longitudinal edge and held in place by screws or the like, or the two pieces may be cemented together if formed of plastic.

Means must be provided to retain the arm of a patient in engagement with the cushioned surface 22 of the arm receiving portion 18. FIGS. 1 and 2 illustrate an arrangement wherein pairs of straps spaced apart from each other are employed. Each pair includes a first strap 26 having one end fixed to the body member 12 and extending over the arm 24 of the user. The other strap 28 of each pair is affixed to the upper edge 20 of the arm support portion 18, or to the outer surface of the arm support portion 18 and extends over edge 20. Some means is provided to retain strap 28 in engagement with strap 26. One means is by the provision of a Velcro attachment system, an attachment system frequently employed for hospital applications such as used on the cuff portion of sphygmomanometers and consists of one part of fabric material which is attached to one of the straps and the other part of small flexible plastic hook members which is attached to the other strap. It can be seen that instead of a Velcro attachment system, snaps, buckles, or other attachment devices could be used.

Figure 4:
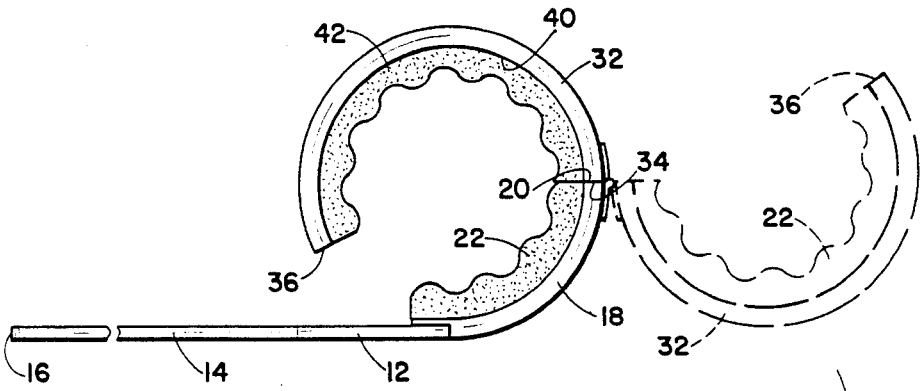
FIG. 4 is a cross-sectional view taken along the line 4—4 of FIG. 3 showing in solid outline the arm retention member being pivoted to the closed position for retaining the arm of a user therein and showing in dotted outline the arm retention member pivoted to the open position.
Figure 6:
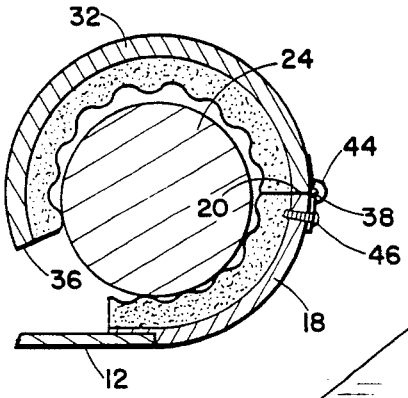
FIG. 6 is a fragmentary cross-sectional view taken along the line 6—6 of FIG. 5 showing the arm of a patient received and held in position by the retention member.
Figure 5:
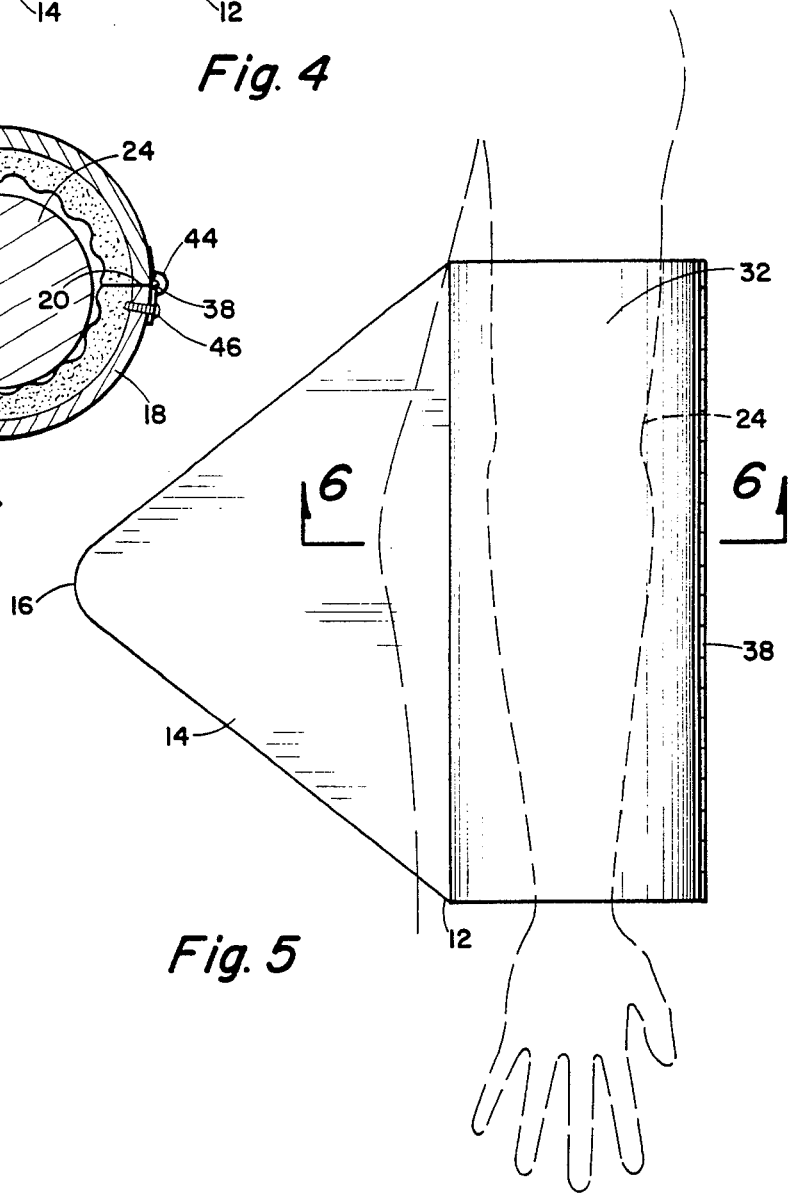
FIG. 5 is a plan view of the embodiment of the invention illustrated in FIGS. 3 and 4 showing in dotted outline the left side of the body of a patient and the left arm as received and supported by the apparatus of this invention.

FIGS. 3, 4, 5, and 6 show an alternate embodiment of the invention. The body member 12, integral tongue portion 14, and arm receiving portion 18 are all generally constructed the same as described with references to FIGS. 1 and 2. Instead of straps, however, a rigid retention member 32 is provided. The member 32 is of material such as metal, plastics, or fiberglass, and is elongated, being generally of the same length as the arm receiving portion 18. In cross-section, as shown in FIGS. 4 and 6, the arm retention member 32 is substantially semi-circular. It has a first longitudinal edge 34 and a second longitudinal edge 36. The elongated edge 34 is pivotally supported, such as by means of a hinge 38, to the longitudinal edge 20 of the arm support portion 18. The inner surface 40 of the arm retention member is provided with cushion material 42 which preferably may also be of foam plastic of egg crate configuration.

In FIG. 4 the retention member 32 is shown in open position in dotted outline so that a patient's arm can readily be positioned on the arm receiving portion, after which the retention member is pivoted to the closed position.

Some means needs to be provided to maintain the arm retention member 32 in closed position. FIG. 6 illustrates the use of a spring member 44 which extends over the hinge 38 and is attached along one edge to the member 18 by means of screws or bolts 46. Spring 14 is merely exemplary of other spring arrangements which can be employed to bias the retention member 32 to the closed position so that except when it is manually forced to the open position as in dotted outline in FIG. 4, it returns to the closed position to retain a patient's arm therein. Another method is the use of a self-locking hinge. Still another means of retaining the retention member 32 in a closed position is the use of straps attached to it and to the body member 12 as described with reference to FIGS. 1 and 2. Any means of retaining or biasing the retention member 32 to the closed position is within the scope of the invention.

When a surgical procedure requires the placement of a patient in such a way that one or both arms of the patient may be inadequately or unsafely supported, the device of this invention may be expeditiously employed. All that is necessary is that the integral tongue portion be slid under the patient and the patient's arm placed in the device. In this manner the arm of the patient is safely and comfortably supported. When the surgical or post-surgical procedures are completed, the device can quickly be removed by removing the patient's arm and sliding the tongue portion from under the user. Thus the device does not require any attachments to the operating table. It is relatively inexpensive of construction and simple of operation and at the same time can substantially increase the safety of patients during certain surgical procedures.

While the invention has been described with a certain degree of particularity, it is manifest that many changes may be made in the details of construction and the arrangement of components without departing from the spirit and scope of this disclosure. It is understood that the invention is not limited to the exemplified embodiments set forth herein but is to be limited only by the scope of the attached claim or claims, including the full range of equivalency to which each element thereof is entitled.

What is claimed:

1. Apparatus for supporting the arm of a patient to an operating table, comprising:

a member of relatively thin rigid material having an integral generally planar and triangular shaped tongue portion having an inner and an outer end, the outer end being of a length equal to substantially the length of the portion of the arm of a patient to be supported and tapering inwardly to the inner end, the inner end being rounded, the length of the tongue portion from the inner to the outer end being at least one-half the width of the body of a patient, the tongue portion being thereby configured to slip between the body of a patient and the support surface of an operating table, the member having an integral arm receiving portion extending from the tongue portion outer end of a length to receive a substantial portion of the length of the arm of a patient, the arm receiving portion being upwardly and outwardly curved, the outer edge being above the plane of the tongue portion of a height of about the thickness of the arm of the patient;

means on the surface of said arm receiving portion to cushion the patient's arm supported thereon;

and means to retain the arm of the patient in engagement with said cushion surface of said arm receiving portion.

2. Apparatus for supporting the arm of a patient on an operating table according to claim 1 wherein said means of retaining the arm of the patient in engagement with said cushioned surface of said arm receiving portion includes at least one strap removably connectable from the upper edge of said arm receiving portion and said member planar portion, said straps extending over the arm of the user.

3. Apparatus for supporting the arm of a patient on an operating table according to claim 2 wherein said straps are each in the form of pairs of straps one of each pair extending from the upper edge of said arm receiving portion and the other strap of each of said pairs extending from said member planar portion, and means to removably attach said straps together.

4. Apparatus for supporting the arm of a patient on an operating table according to claim 3 wherein said means to removably attach said straps together includes Velcro attaching means.

5. Apparatus for supporting the arm of a patient on an operating table according to claim 1 wherein said means to retain the arm of the patient in engagement with said cushioned surface of said arm receiving portion includes:

an arm retention member pivotally affixed to the upper edge of said arm support member.

6. Apparatus for supporting the arm of a patient on an operating table according to claim 5 wherein said arm retention member is in the form of an elongated member of rigid material of length substantially equal the length of said arm receiving portion and being hinged along one longitudinal edge to the upper edge of said arm receiving portion, said retention member being substantially semicircular in cross-section and pivotal between an open position in which the arm of a patient may be placed on said arm receiving portion and a closed position in which the retention member is pivoted over the arm of a patient.

7. Apparatus for supporting the arm of a patient on an operating table according to claim 6 including means of retaining said arm retention member in the closed position.

* * * * *